US009423206B2

(12) United States Patent
Annuzzi, Jr.

(10) Patent No.: US 9,423,206 B2
(45) Date of Patent: Aug. 23, 2016

(54) ADAPTER FOR AIR RIFLE TANK

(76) Inventor: Anthony A. Annuzzi, Jr., Jacksonville, FL (US)

( * ) Notice: Subject to any disclaimer, the term of this patent is extended or adjusted under 35 U.S.C. 154(b) by 0 days.

(21) Appl. No.: 13/401,785

(22) Filed: Feb. 21, 2012

(65) Prior Publication Data

US 2013/0214526 A1 Aug. 22, 2013

(51) Int. Cl.
*F41B 11/60* (2013.01)
*F41B 11/62* (2013.01)
*F41B 11/724* (2013.01)

(52) U.S. Cl.
CPC ..... *F41B 11/62* (2013.01); *F41B 11/724* (2013.01)

(58) Field of Classification Search
CPC ..... F41B 1/60; F41B 11/62; F41B 11/701
USPC ..... 124/72, 73; 285/93, 125.1, 129.1, 285/129.2, 130.1, 133.4
See application file for complete search history.

(56) References Cited

U.S. PATENT DOCUMENTS

| | | | | | |
|---|---|---|---|---|---|
| 2,731,975 | A * | 1/1956 | Boals | 137/116.5 |
| D195,243 | S * | 5/1963 | Kelly | D23/263 |
| 4,221,406 | A * | 9/1980 | Traylor | 285/119 |
| D284,887 | S * | 7/1986 | Milo | D23/263 |
| 4,615,547 | A * | 10/1986 | Sutcliffe et al. | 285/121.6 |
| 4,804,206 | A * | 2/1989 | Wood et al. | 285/13 |
| 5,613,483 | A * | 3/1997 | Lukas et al. | 124/73 |
| 5,931,182 | A * | 8/1999 | Craft et al. | 137/116.5 |
| 5,950,611 | A * | 9/1999 | Lopez et al. | 124/72 |
| 6,295,752 | B1 * | 10/2001 | Havlock | 42/76.01 |
| 6,405,722 | B2 * | 6/2002 | Colby | 124/74 |
| 6,766,795 | B1 * | 7/2004 | Sullivan | 124/56 |
| 6,959,703 | B1 * | 11/2005 | Spurlock et al. | 124/74 |
| D512,751 | S * | 12/2005 | Malmloff | D21/573 |
| 7,107,981 | B1 * | 9/2006 | Dunn | 124/80 |
| 7,565,911 | B2 * | 7/2009 | Bonta, Jr. | 137/14 |
| 7,866,309 | B2 * | 1/2011 | Juan | 124/73 |
| 8,171,950 | B2 * | 5/2012 | Colby et al. | 137/15.01 |
| 2001/0050076 | A1 * | 12/2001 | Colby | 124/74 |
| 2001/0054441 | A1 * | 12/2001 | Colby | 137/505 |
| 2002/0104524 | A1 * | 8/2002 | Reible | 124/73 |
| 2003/0034021 | A1 * | 2/2003 | Gabrel | 124/71 |
| 2006/0236991 | A1 * | 10/2006 | Gan | 124/73 |
| 2007/0113835 | A1 * | 5/2007 | Yeh | 124/73 |
| 2007/0256743 | A1 * | 11/2007 | Carpenter et al. | 137/614.2 |
| 2008/0210210 | A1 * | 9/2008 | Colby | 124/73 |
| 2009/0283084 | A1 * | 11/2009 | Tran | 124/74 |
| 2009/0301581 | A1 * | 12/2009 | MacNeal et al. | 137/505.14 |
| 2011/0290227 | A1 * | 12/2011 | Williford | 124/56 |

* cited by examiner

*Primary Examiner* — Bret Hayes
*Assistant Examiner* — Derrick Morgan
(74) *Attorney, Agent, or Firm* — Mark Young, P.A.

(57) ABSTRACT

A pre-charged pneumatic air rifle air tank adapter lowers an air tank relative to the pre-charged pneumatic air rifle. The lowered air tank facilitates aiming. The adapter also provides a substrate for mounting accessories including a quick disconnect refill plug and a pressure gauge. The adapter includes a female rifle fitting with a threaded central conduit, a male air tank fitting with a central conduit and external threads parallel to, coplanar with and about 0.75 to 1.5 inches apart in elevation from the central conduit of the female rifle fitting, measured vertically from centerline to centerline. A body of the adapter has an internal conduit extending from the female rifle fitting to the male air tank fitting.

18 Claims, 7 Drawing Sheets

ADAPTER FOR AIR RIFLE TANK

FIELD OF THE INVENTION

This invention relates generally to air guns, and, more particularly, to an adapter to reposition a compressed air tank of a pre-charged pneumatic rifle and facilitate pressure measurement and refilling.

BACKGROUND

A pre-charged pneumatic (PCP) rifle releases compressed air to drive a projectile. A tank stores the compressed air. The tank has a threaded neck for connecting to a rifle. Cocking the rifle exposes a breech for manually loading a projectile. During firing, a hammer is released to strike a valve. Prior to being struck by the hammer, the valve is held closed by a spring and the pressure of the compressed air in the tank. When struck by the hammer, the valve opens briefly to release a burst of compressed air. The compressed air drives the projectile from the breach and through the barrel of the rifle.

Unfortunately, the tank must be removed from the gun for refilling after a limited number of firings (e.g., 25 to 40). The tank is usually filled from a high pressure air supply, such as a diving cylinder, or by recharging with a hand pump. Refilling requires use of special adapters to couple the tank to the diving cylinder or pump. Frequent removal and refilling is not only time consuming and laborious, but also risks damage to the threaded neck.

Determining when a refill is necessary can be difficult, particularly for rifles not equipped with pressure gauges. While a user may sense a lack of sufficient pressure as the tank is depleted, this method of pressure management is highly imprecise. Counting the number of shots is inconvenient, conducive to error and ineffective for a rifle with an undetermined number of prior shots from a tank. Additionally, neither of these methods enables a user to determine the pressure before the rifle is fired.

In some air rifles, the centerline of the tank is aligned with the centerline of the barrel. In such rifles, the tank doubles as a butt stock. However, because the tank is bulbous, it can interfere with aiming. A scope is typically mounted to such a rifle using high scope mounts. As the distance between the barrel and a high scope is substantial, aiming is compromised, resulting in frustration and fewer target hits. Lowering the height of the scope to bring the line of sight closer to the projectile path will result in discomfort. A shooter may have to cram his head onto the tank and crank his head at an extreme angle in order to aim through a low scope. Conversely, if the scope is mounted too high, not only will aiming be compromised but the shooter may find himself hovering over the tank, without his head touching it. Either case will induce unsteadiness as a shooter fights to acquire a sight.

The invention is directed to overcoming one or more of the problems and solving one or more of the needs as set forth above.

SUMMARY OF THE INVENTION

To solve one or more of the problems set forth above, in an exemplary implementation of the invention, a pre-charged pneumatic air rifle air tank adapter lowers an air tank relative to the pre-charged pneumatic air rifle. The lowered air tank facilitates aiming. The adapter also provides a substrate for mounting accessories, including a quick disconnect refill plug and a pressure gauge. These accessories facilitate refilling and monitoring the pressurized state of the tank.

An exemplary adapter includes a female rifle fitting that has a threaded central conduit. The threaded central conduit has internal threads, a length and an inner diameter configured to threadedly receive a tank mounting fitting. The adapter also has a male air tank fitting with a central conduit, external threads, a length and an outer diameter configured to threadedly engage a neck of an air tank for the pre-charged pneumatic air rifle. The centerline of the central conduit of the female rifle fitting and the centerline of the central conduit of the male tank fitting are parallel, coplanar (i.e., aligned in a plane) and about 0.75 to 1.5 inches apart in elevation, preferably about 1 inch apart in elevation, measured vertically from centerline to centerline. This difference in elevation enables lowering the tank by the distance. A body of the adapter has an internal conduit extending from the female rifle fitting to the male air tank fitting. The internal conduit of the body fluidly couples the threaded central conduit of the female rifle fitting to the central conduit of the male air tank fitting. The internal conduit of the body, which fluidly couples the threaded central conduit of the female rifle fitting to the central conduit of the male air tank fitting, is oriented at an acute angle (about between 30 to 75 degrees) relative to the central conduit of the male tank fitting.

Optionally, the adapter has one or more accessories. The body has a first side and an opposite second side. A first threaded aperture is provided in the first side. The threaded aperture is in fluid communication with the internal conduit of the body. A pressure gauge with an analog display and threaded fitting opposite the analog display is threadedly received in the first threaded aperture in the first side of the body. The analog display of the pressure gauge responds to gas pressure within the internal conduit of the body. The pressure gauge is configured to measure pressure up to about at least 3000 psi.

The body has a second threaded aperture in the second side. The second threaded aperture is in fluid communication with the internal conduit of the body. A quick disconnect plug with a coupling end and a threaded fitting opposite the coupling end is threadedly received in the second threaded aperture in the second side of the body. The quick disconnect plug provides a "make or break" fluid-tight seal, until engaged by a female quick disconnect coupling.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

Figure 1:
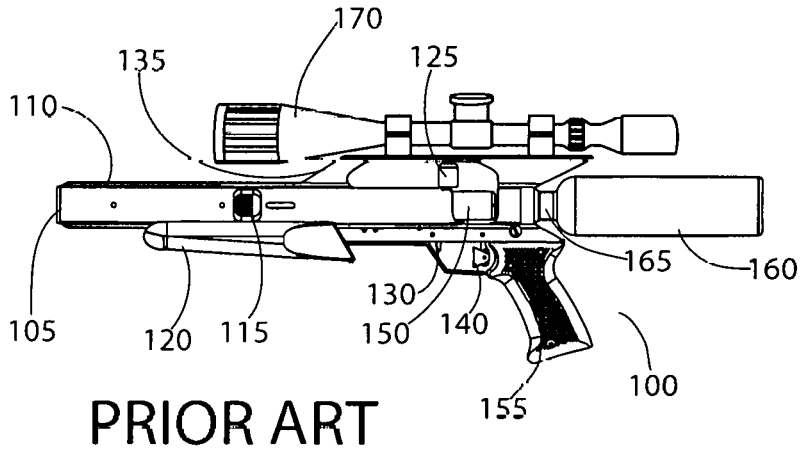
PRIOR ART FIGURE 1
FIG. 1 is a side view of an exemplary prior art air rifle with an air tank.

Referring to FIG. 1, an exemplary prior art rifle 100 includes a barrel 105 with an open end, an upper accessory rail 110, a power adjust wheel 115, a forearm 120, a cocking handle 125, a safety 130, a scope mount 135, a trigger 140, a bolt 150, a pistol grip 155, a compressed air tank 160 with a neck 165, and a scope 170. The exemplary air rifle is intended to represent a range of air rifles having a tank 160 aligned with the barrel 105. Such air rifles may have additional and or different features. One exemplary prior art rifle for which an adapter according to principles of the invention is well suited is an Air Force TalonP® air rifle by Auto-Numatic Corporation, a Texas corporation, d/b/a Air-Force Airguns.

Figure 2:
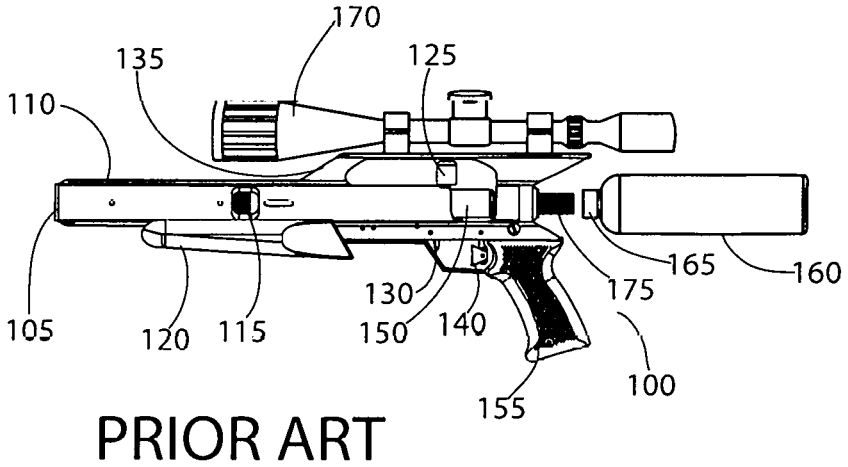
PRIOR ART FIGURE 2
FIG. 2 is a side view of the exemplary prior art air rifle with the air tank removed.
Figure 3:
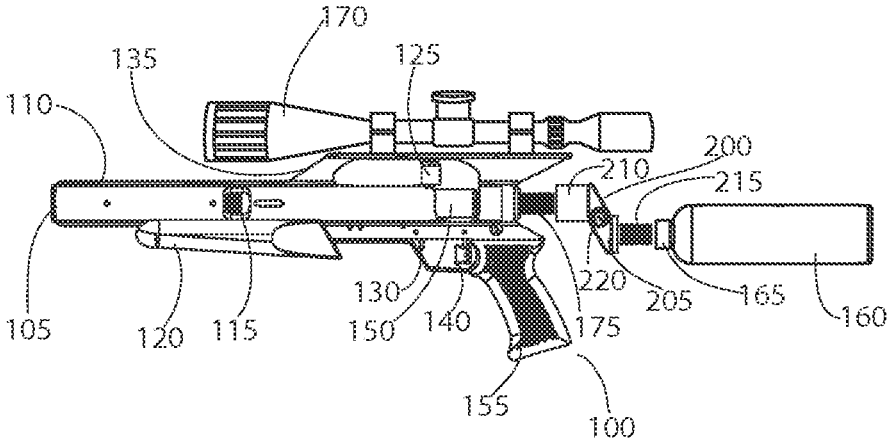
FIG. 3 is a side view of the exemplary prior art air rifle with an exemplary adapter according to principles of the invention.
Figure 4:
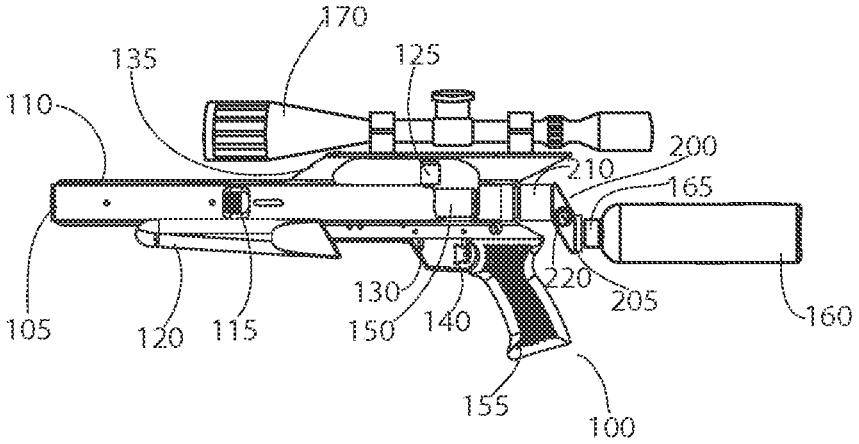
FIG. 4 is a side view of the exemplary prior art air rifle with an installed exemplary adapter according to principles of the invention.
Figure 5:
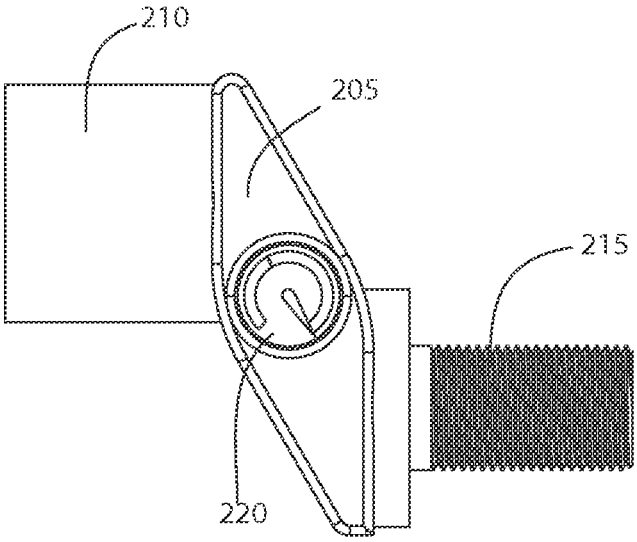
FIG. 5 is a first side view of the exemplary adapter according to principles of the invention.
Figure 6:
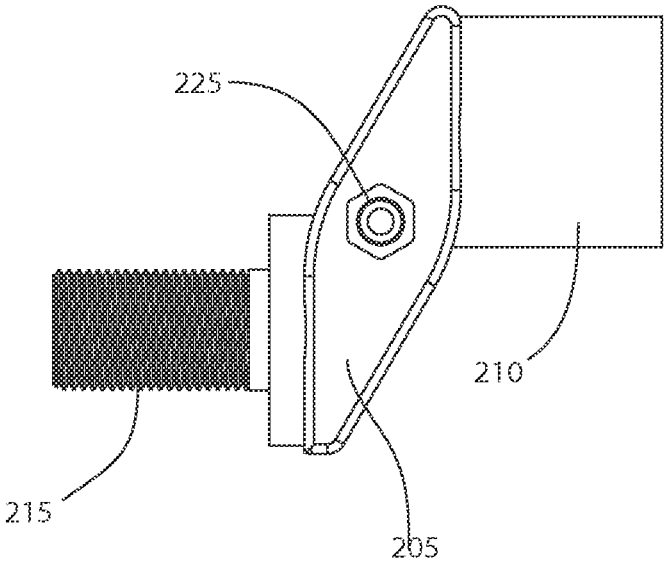
FIG. 6 is a second side view of the exemplary adapter according to principles of the invention.
Figure 7:
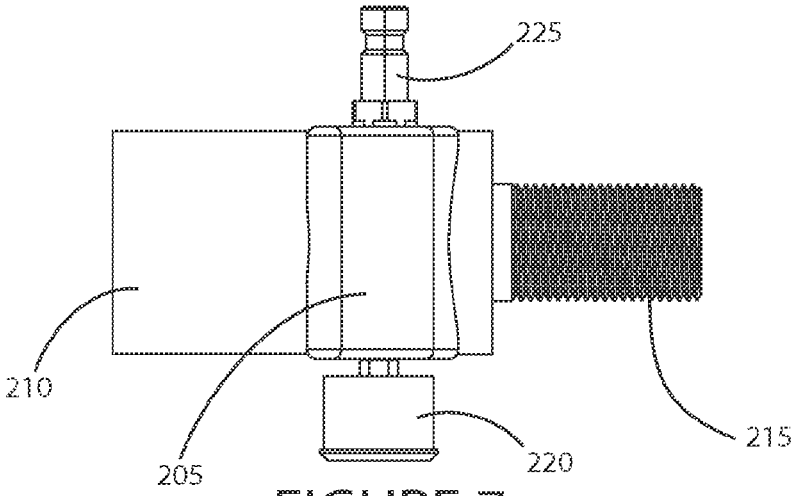
FIG. 7 is a plan side view of the exemplary adapter according to principles of the invention.
Figure 8:
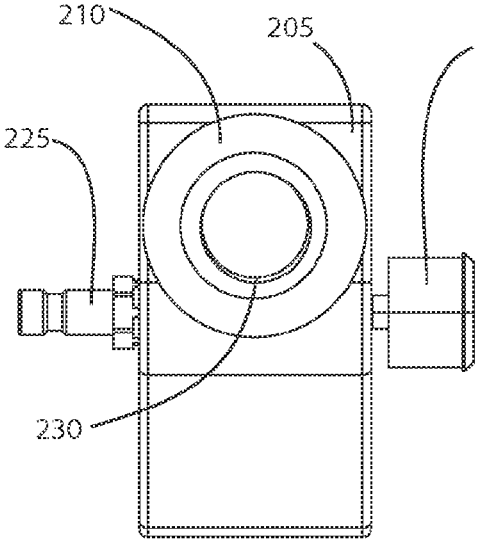
FIG. 8 is a rifle end view of the exemplary adapter according to principles of the invention.
Figure 9:
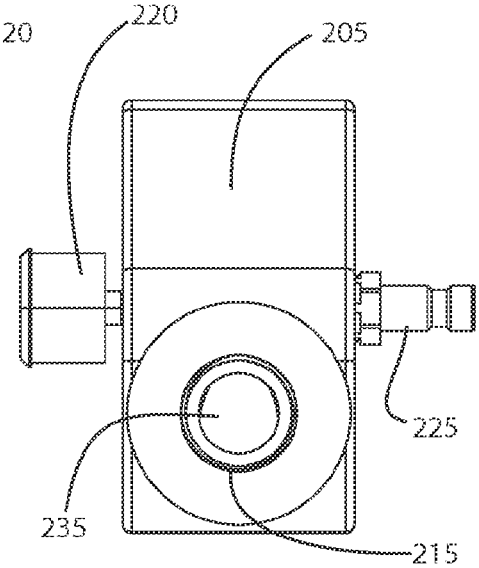
FIG. 9 is a tank end view of the exemplary adapter according to principles of the invention.
Figure 10:
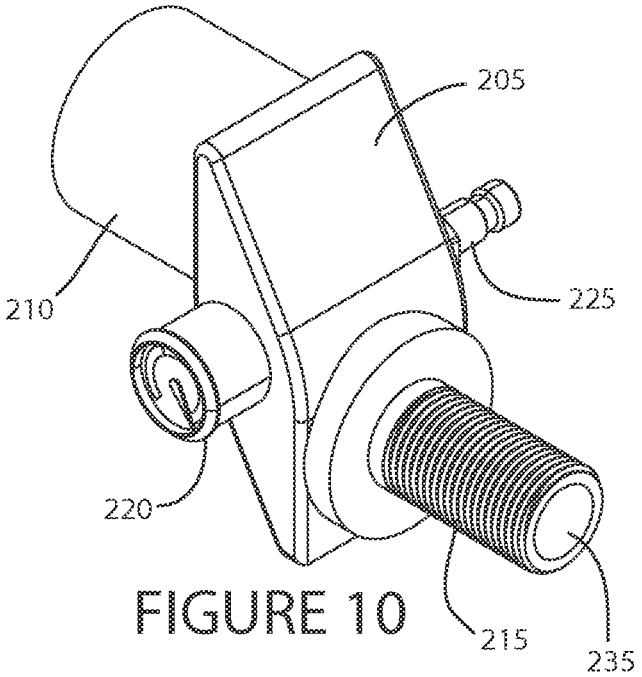
FIG. 10 is a first perspective view of the exemplary adapter according to principles of the invention.
Figure 11:
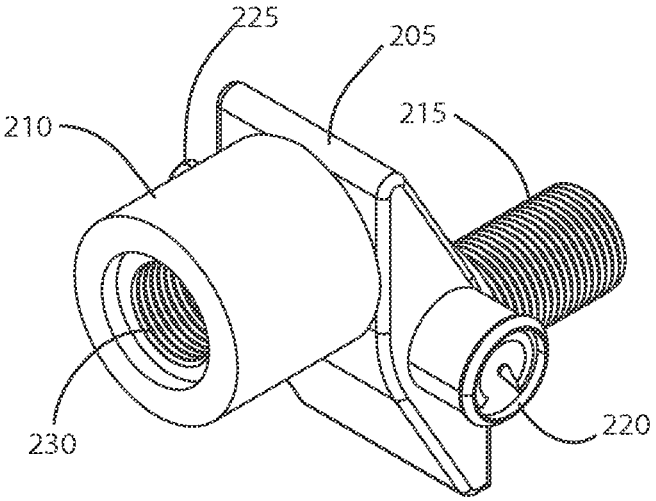
FIG. 11 is a second perspective view of the exemplary adapter according to principles of the invention.
Figure 12:
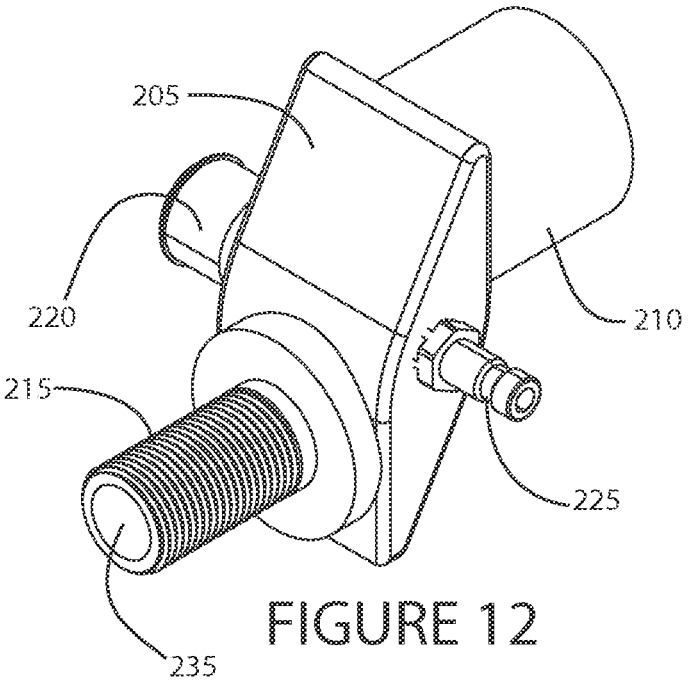
FIG. 12 is a third perspective view of the exemplary adapter according to principles of the invention.
Figure 13:
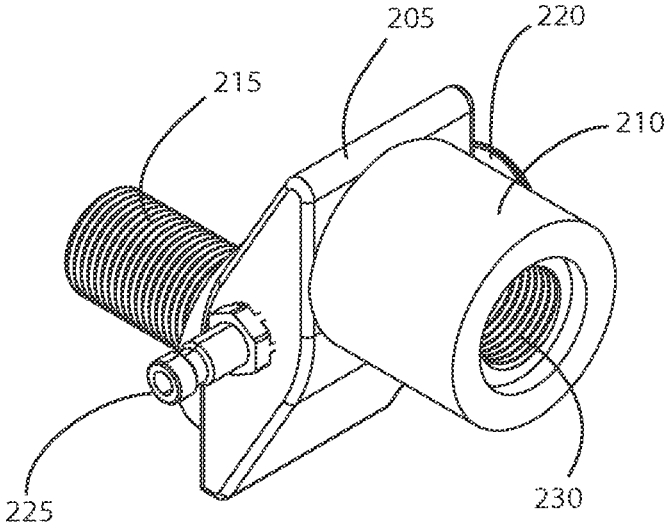
FIG. 13 is a fourth perspective view of the exemplary adapter according to principles of the invention.

In FIG. 2, the tank 160 is removed from the air rifle 100 by unscrewing, exposing a threaded male fitting 175 (i.e., tank mounting fitting) for threadedly receiving the tank 160. In FIG. 3, an adapter 200 according to principles of the invention is positioned between the rifle 100 and air tank 160 for installation. As shown in FIGS. 3 and 4, the adapter 200 includes a body 205 with a conduit extending from a rifle fitting 210 to an air tank fitting 215. The adapter 200 lowers the air tank 160 a determined distance and moves it away from the rifle 100. In doing so, the adapter 200 facilities aiming through the scope 170. The downward adjustment allows a shooter to comfortably position his head on the tank 160 while taking aim through the scope 170. The adapter 100, including benefits of the adapter 100, is discussed in more detail below.

As shown in FIGS. 5 through 13, the adapter 200 includes a body 205 with a conduit extending from a rifle fitting 210 to an air tank fitting 215. The rifle fitting 210 comprises a female threaded aperture 230 (i.e., a conduit) configured to threadedly engage the threaded male fitting 175 extending from the back of the rifle 100. For different rifles, the rifle fitting 210 diameter and threads may vary. The air tank fitting 215, which is opposite the rifle fitting 210, is a male threaded fitting with a central aperture 235 (i.e., a conduit). The air tank fitting 215 is configured to threadedly engage the neck 165 of the tank 160. For different air tanks, the air tank fitting 215 diameter and threads may vary. The aperture 230 of the rifle fitting 210 and the aperture 235 of the tank fitting 215 are fluidly coupled by a conduit in the body 205. Thus, compressed air from an air tank may flow into the aperture 235 of the tank fitting 215, through the body 205 and out of the aperture 230 of the rifle fitting 210 into the rifle 100.

The exemplary adapter includes a pressure gauge 220. The pressure gauge 220 is attached to a side of the body 205. The gauge 220 may be attached by threading into a threaded hole in the side of the body 205. The sensing end of the pressure gauge 220 is within the hole and in fluid communication with the conduit in the body 205. The reading end of the pressure gauge 220 faces outwardly from the side of the body 205. Thus, in the unlikely event of failure of the gauge, any components of the gauge are not propelled sideways, not towards the users face. Any pressure gauge that is small enough to attach to the side of the body 205, without interfering with use of the rifle and capable of gauging pressure up to at least about 3000 psi, may be used. However, in an exemplary embodiment, the pressure gauge is a Bourdon gauge that contains narrow coiled or C-shaped tubes which tend to straighten or deform into a larger diameter coil as pressure increases. As pressure increases, the motion of the tube is converted by gears into rotation of a needle. Such gauges measure pressure, relative to ambient atmospheric pressure, as opposed to absolute pressure with sufficient accuracy for determining the pressurized state of the tank 160, determining when a refill may be necessary, determining how many more shots may be fired before the pressure drops to a level below which performance is compromised, and detecting leaks.

The exemplary adapter includes a quick connect plug 225, also known as a quick disconnect or quick release coupling. The plug 225 is attached to the side of the body 205 opposite the pressure gauge 220. The plug 225 may be attached by threading into a threaded hole in the side of the body 205. A threaded end of the plug 225 is within the hole and in fluid communication with the conduit in the body 205. The other end of the plug 225 faces outwardly from the side of the body 205. The quick connect plug 225 provides a fast, make-or-break connection for fluid (i.e., compressed gas) transfer. A preferred quick connect plug 225 contains a poppet valve used to stop fluid (e.g., compressed air) from flowing when the two mating parts of a quick disconnect are separated. The poppet valve is a spring biased valve that is urged into an open position when connected to a female quick disconnect coupler. Thus, the quick connect plug 225 enables refilling the tank 160 through the adapter 200 without disconnecting the tank 160 from the adapter 200.

To refill the tank 160, a source of pressurized gas (e.g., a compressed air source) may be coupled to the plug 225 using a mating quick connect female coupler and a hose leading to the source. The plug 225 contains a self-sealing valve, which, upon disconnection, will automatically contain compressed gas in the adapter 200. When coupled to a mating female quick disconnect fitting, the sealing valve in the plug 225 is urged open. So long as the pressure of the source exceeds the pressure of the tank 160, and the volume of pressurized gas in the source is sufficient to refill the tank 160, the pressurized gas should flow from the source to the tank and refill the tank 160. When the pressure in the tank 160 is restored to the full pressure, as determined by monitoring the pressure gauge 220, the source of pressurized gas may be disconnected. Upon disconnection, the self-sealing valve in the plug 225 closes and automatically contains compressed gas in the adapter 200 and the connected tank 160.

Figure 14:
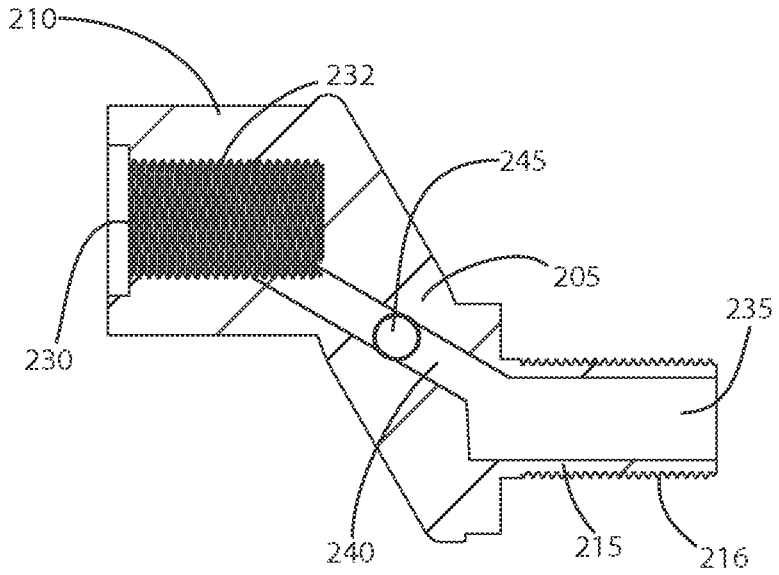
FIG. 14 is a section view of the exemplary adapter according to principles of the invention.

Referring now to FIG. 14, a section view of the exemplary adapter 200 is provided. The section view shows the internal threads 232 in the aperture 230 of the rifle fitting 210, the external threads 216 and aperture 235 of the tank fitting 215, and the conduit 240 disposed in the body 205 between, and fluidly coupling, the apertures 230 and 235. Also shown is a threaded aperture 245 into which an accessory, such as a pressure gauge or a quick connect fitting, may be threadedly connected. An exemplary pressure gauge 220 and quick connect plug 225 are described above.

Figure 15:
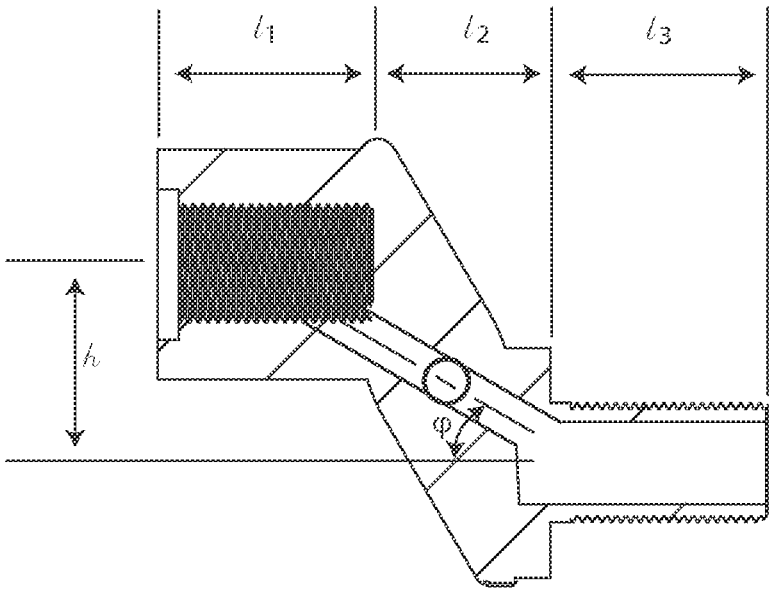
FIG. 15 is a dimensioned view of the exemplary adapter according to principles of the invention.

An important aspect of the exemplary adapter 200 is the configuration of the conduit 240 disposed in the body 205 between, and fluidly coupling, the apertures 230 and 235. To mill the adapter from a single piece of aluminum, such that the adapter 200, excluding its accessories, is integrally formed, the conduit 240 must be angled to be formed by inserting a bit straight through the aperture 230 of the rifle fitting 210. A conduit 240 as shown in FIGS. 14 and 15 may be milled using a straight bit. Because the aperture 230 of the rifle fitting 210 has a larger diameter than the aperture 235 of the tank fitting 215, a bit is inserted at an angle through the aperture 230 of the rifle fitting 210 to form the conduit 240. The conduit 240 is not formed by inserting a bit through the much narrower aperture 235 of the tank fitting 215, which would interfere with the necessary angling.

With reference to FIG. 15, the adapter 200 lowers the tank 160 by a determined distance h, preferably about 0.75 to 1.5 inches, and more preferably about 1.0 inches. In a preferred embodiment, the angle, $\phi$, of the centerline of the body 205 is acute. The exterior surfaces of the body, which may be planar, non-planar or curved, generally follow the angle, $\phi$. Thus, the surfaces may be parallel or nearly parallel to the centerline of the body 205. This angled configuration ensures adequate clearance, so that the body 205 does not interfere with structure of the rifle. The lengths, $l_1$, $l_2$, and $l_3$, are approximately 1 to 1½ inches, and, more preferably, about 1 inch, about 1 to 1.25 inches and about 1.25 inches, respectively. Variations of about ±15% are within the scope of the aforementioned measurements.

Using an adapter 200 according to principles of the invention confers several benefits. The adapter 200 facilitates aiming by lowering the tank 160 relative to air rifle 100. The adapter 200 provides a pressure gauge for accurately determining the pressurized condition of the tank 160. Thus a user may quickly and accurately determine if and when a refill is needed and spot a leak. The adapter 200 also provides a refill plug 225, enabling a user to refill the tank without disconnection from the air rifle.

The adapter 200 may be comprised of a wide range of materials, including metals, composites and plastics. However, in a preferred embodiment, the adapter 200 is comprised of anodized aluminum, which offers acceptable strength, durability and corrosion resistance. Additionally, in a preferred embodiment, the body, female rifle fitting and male tank fitting of the adapter (i.e., the entire adapter excluding accessories) is integrally formed. Integrally forming the adapter avoids seams that may be susceptible to leaking, especially when subjected to the high pressure compressed gas that drives the air rifle. The risk of leakage from seams increases further, as the rifle is used in various temperatures causing expansion or contraction, and as the rifle is used in humid and wet conditions which can saturate, dry, corrode and degrade gaskets and sealants, and as the rifle is manhandled during ordinary use.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. An adapter for a pre-charged pneumatic air rifle, said adapter lowering an air tank relative to the pre-charged pneumatic air rifle, said adapter comprising:

a female rifle fitting having a threaded central conduit, said threaded central conduit having internal threads, a length, an inner diameter configured to threadedly receive a tank mounting fitting, a front opening through which the tank mounting fitting can be received, a back opposite the front opening, a top portion and an opposite bottom portion; and a male air tank fitting having a central conduit, external threads, a length and an outer diameter configured to threadedly engage a neck of an air tank for the pre-charged pneumatic air rifle; and a centerline of the threaded central conduit of the female rifle fitting and a centerline of the central conduit of the male air tank fitting being parallel, coplanar and at least about 0.75 inches apart in elevation; and a body having straight oblique internal conduit extending from the back bottom portion of the female rifle fitting to the male air tank fitting, the straight oblique internal conduit of the body fluidly coupling the threaded central conduit of the female rifle fitting to the central conduit of the male air tank fitting, the straight oblique internal conduit of the body having a centerline extending through the front opening of the female rifle fitting;

said adapter being seamless and integrally formed, and said female rifle fitting, including the threaded central conduit of the female rifle fitting, and said male air tank fitting, including the central conduit of the male air tank fitting, and said straight oblique internal conduit of the body, being machined.

2. The adapter for the pre-charged pneumatic air rifle according to claim 1:

said body having a first side and an opposite second side; and said body having a first threaded aperture in the first side, said threaded aperture being in fluid communication with the straight oblique internal conduit of the body, and said adapter further comprising a pressure gauge with an analog display and threaded fitting, said threaded fitting of the pressure gauge being threadedly received in the first threaded aperture in the first side of the body; and said analog display of said pressure gauge being external to the body and responding to gas pressure within the straight oblique internal conduit of the body.

3. The adapter for the pre-charged pneumatic air rifle according to claim 2:

said body having a second threaded aperture in the second side, said second threaded aperture being in fluid communication with the straight oblique internal conduit of the body, and said adapter further comprising a quick disconnect plug having a coupling end and a threaded fitting opposite the coupling end, said threaded fitting of the quick disconnect plug being threadedly received in the second threaded aperture in the second side of the body, said quick disconnect plug providing a fluid-tight seal until engaged by a female quick disconnect coupling.

4. The adapter for the pre-charged pneumatic air rifle according to claim 2:

said pressure gauge being configured to measure pressure up to about at least 3000 psi.

5. The adapter for the pre-charged pneumatic air rifle according to claim 1:

said body having a first side and an opposite second side; and said body having a second threaded aperture in the second side, said second threaded aperture being in fluid communication with the straight oblique internal conduit of the body, and said adapter further comprising a quick disconnect plug having a coupling end and a threaded fitting opposite the coupling end, said threaded fitting of the quick disconnect plug being threadedly received in the second threaded aperture in the second side of the body, said quick disconnect plug providing a fluid-tight seal until engaged by a female quick disconnect coupling.

6. The adapter for the pre-charged pneumatic air rifle according to claim 1:

the centerline of the threaded central conduit of the female rifle fitting and the centerline of the central conduit of the male air tank fitting being about 1.0 inch apart in elevation.

7. The adapter for the pre-charged pneumatic air rifle according to claim 1:

the straight oblique internal conduit of the body fluidly coupling the threaded central conduit of the female rifle fitting to the central conduit of the male air tank fitting being oriented at an acute angle relative to the central conduit of the male air tank fitting.

8. The adapter for the pre-charged pneumatic air rifle according to claim 7:

wherein the acute angle is about 30 to 75 degrees.

9. The adapter for the pre-charged pneumatic air rifle according to claim 1, said adapter comprising:

the threaded central conduit of the female rifle fitting and a centerline of the central conduit of the male air tank fitting being about 0.75 to 1.5 inches apart in elevation.

10. The adapter for the pre-charged pneumatic air rifle according to claim 9:

said pressure gauge measuring pressure up to about at least 3000 psi.

11. The adapter for the pre-charged pneumatic air rifle according to claim 10:

the centerline of the threaded central conduit of the female rifle fitting and the centerline of the central conduit of the male air tank fitting being 1.0 inch apart in elevation.

12. The adapter for the pre-charged pneumatic air rifle according to claim 11:

the straight oblique internal conduit of the body fluidly coupling the threaded central conduit of the female rifle fitting to the central conduit of the male air tank fitting being oriented at an acute angle relative to the central conduit of the male air tank fitting, the acute angle being about 30 to 75 degrees.

13. A pre-charged pneumatic air rifle equipped with a scope and an air tank adapter for lowering an air tank relative to the scope of the pre-charged pneumatic air rifle, said pre-charged pneumatic air rifle comprising:

a pre-charged pneumatic air rifle equipped with a scope; and said adapter comprising:

a female rifle fitting having a threaded central conduit, said threaded central conduit having internal threads, a length and an inner diameter configured to threadedly receive a tank mounting fitting of the pre-charged pneumatic air rifle, a front opening through which the tank mounting fitting can be received, a back opposite the front opening, a top portion and an opposite bottom portion; and a male air tank fitting having a central conduit, external threads, a length and an outer diameter configured to threadedly engage a neck of an air tank for the pre-charged pneumatic air rifle; and a centerline of the threaded central conduit of the female rifle fitting and a centerline of the central conduit of the male air tank fitting being parallel, coplanar and from 0.75 to 1.5 inches apart in elevation; and a body having a straight oblique internal conduit extending from the female rifle fitting to the male air tank fitting, the straight oblique internal conduit of the body fluidly coupling the threaded central conduit of the female rifle fitting to the central conduit of the male air tank fitting, the straight oblique internal conduit of the body having a centerline extending through the front opening of the female rifle fitting;

said adapter being seamless and integrally formed, and said female rifle fitting, including the threaded central conduit of the female rifle fitting, and said male air tank fitting, including the central conduit of the male air tank fitting, and said straight oblique internal conduit of the body, being machined and fluidly coupling the air tank to the pre-charged pneumatic air rifle.

14. The pre-charged pneumatic air rifle equipped with a scope and an air tank adapter for lowering an air tank relative to the scope of the pre-charged pneumatic air rifle, according to claim 13:

said body having a first side and an opposite second side; and said body having a first threaded aperture in the first side, said threaded aperture being in fluid communication with the straight oblique internal conduit of the body, and said adapter further comprising a pressure gauge with an analog display and threaded fitting, said threaded fitting of the pressure gauge being threadedly received in the first threaded aperture in the first side of the body; and said analog display of said pressure gauge being external to the body and responding to gas pressure within the straight oblique internal conduit of the body.

15. The pre-charged pneumatic air rifle equipped with a scope and an air tank adapter for lowering an air tank relative to the scope of the pre-charged pneumatic air rifle, according to claim 14:

said body having a second threaded aperture in the second side, said second threaded aperture being in fluid communication with the straight oblique internal conduit of the body, and said adapter further comprising a quick disconnect plug having a coupling end and a threaded fitting opposite the coupling end, said threaded fitting of the quick disconnect plug being threadedly received in the second threaded aperture in the second side of the body, said quick disconnect plug providing a fluid-tight seal until engaged by a female quick disconnect coupling.

16. The pre-charged pneumatic air rifle equipped with a scope and an air tank adapter for lowering an air tank relative to the scope of the pre-charged pneumatic air rifle, according to claim 15:

wherein said pressure gauge is configured to measure pressure up to about at least 3000 psi.

17. The pre-charged pneumatic air rifle equipped with a scope and an air tank adapter for lowering an air tank relative to the scope of the pre-charged pneumatic air rifle, according to claim 16:

the centerline of the threaded central conduit of the female rifle fitting and the centerline of the central conduit of the male air tank fitting being about 1.0 inch apart in elevation.

18. The pre-charged pneumatic air rifle equipped with a scope and an air tank adapter for lowering an air tank relative to the scope of the pre-charged pneumatic air rifle, according to claim 17:

the straight oblique internal conduit of the body fluidly coupling the threaded central conduit of the female rifle fitting to the central conduit of the male air tank fitting being oriented at an acute angle of about 30 to 75 degrees relative to the central conduit of the male air tank fitting.

* * * * *